US007249812B2

(12) United States Patent
Fulop

(10) Patent No.: US 7,249,812 B2
(45) **Date of Patent: *Jul. 31, 2007**

(54) DISPLAY SYSTEM

(76) Inventor: Raymond C. Fulop, 17005 Stag Thicket La., Strongsville, OH (US) 44136

( * ) Notice: Subject to any disclaimer, the term of this patent is extended or adjusted under 35 U.S.C. 154(b) by 242 days.

This patent is subject to a terminal disclaimer.

(21) Appl. No.: 10/650,884

(22) Filed: Aug. 28, 2003

(65) Prior Publication Data

US 2004/0036384 A1 Feb. 26, 2004

Related U.S. Application Data

(63) Continuation-in-part of application No. 10/113,515, filed on Apr. 1, 2002, now Pat. No. 6,676,232.

(51) Int. Cl.
*A47F 3/00* (2006.01)
*A47B 88/00* (2006.01)

(52) U.S. Cl. ..... 312/122; 312/334.7; 248/220.21

(58) Field of Classification Search ..... 312/902, 312/294, 313, 334.1, 140.4, 245, 196, 122, 312/334.7, 334.8, 111, 114; 248/220.21
See application file for complete search history.

(56) References Cited

U.S. PATENT DOCUMENTS 1,663,337 A * 3/1928 Eustis et al. ..... 312/122
2,420,015 A * 5/1947 Salsman et al. ..... 312/276
2,988,412 A 6/1961 Vannice
3,032,381 A 5/1962 Boro
3,251,636 A 5/1966 Hein
3,434,769 A 3/1969 Salet (Continued)

*Primary Examiner*—Carl D. Friedman
*Assistant Examiner*—Tan Le
(74) *Attorney, Agent, or Firm*—Fay Sharpe LLP

(57) ABSTRACT

A frame structure includes a first end wall having first and second ends in a top edge. A second end wall is spaced apart from the first end wall and generally parallel orientation relative to the first end wall. The second end wall has first and second ends in a top edge. A pair of side walls extend between the first and second end walls. The first side wall of the pair of side walls is connected at a first end to the first end wall first end and at a second end to the second end wall first end. A second side wall of the pair of side walls is connected at a first end to the first end wall second wall and at a second end to the second end wall second end. The end walls and the side walls define a base cavity. The pair of sidewalls have upper portions that extend a selected distance beyond the top edges of the first and second end walls. A first pair of slide mechanisms is mounted on the upper portions of the pair of side walls. A first slide mechanism of the first pair of slide mechanisms is mounted on the first side wall and a second corresponding slide mechanism of the first pair of slide mechanisms is mounted on the second side wall. A first support is connected to the first pair of slide mechanisms. The first pair of slide mechanisms is capable of slidably moving the first support between a first position wherein anything carried on the first support is positioned over the base cavity obstructing viewing into the base cavity and second position wherein the first support passes over one of the top edges of the first and second end walls thereby not obstructing viewing into the base cavity.

25 Claims, 16 Drawing Sheets

U.S. PATENT DOCUMENTS 3,748,006 A * 7/1973 Levit et al. ..... 312/111
4,108,515 A 8/1978 Johnson
4,156,549 A 5/1979 Clark
4,396,121 A 8/1983 Lemmon
4,440,461 A * 4/1984 Powell et al. ..... 312/334.8
4,811,996 A 3/1989 Hansson
5,306,077 A 4/1994 Trevaskis
5,607,213 A * 3/1997 Slivon et al. ..... 312/301
5,632,542 A * 5/1997 Krivec ..... 312/334.7
5,690,402 A 11/1997 Koppe
5,871,263 A 2/1999 Johnston et al.
5,893,617 A * 4/1999 Lee ..... 312/263
5,924,778 A 7/1999 TenBrink
6,076,908 A * 6/2000 Maffeo ..... 312/334.7
6,158,578 A 12/2000 Greiner
6,189,594 B1 2/2001 Carter
6,240,687 B1 * 6/2001 Chong ..... 52/238.1
6,378,962 B1 * 4/2002 Green ..... 312/137
6,425,646 B1 * 7/2002 Andrews ..... 312/114
6,431,668 B1 * 8/2002 Reddicliffe ..... 312/334.5
6,676,232 B2 * 1/2004 Fulop ..... 312/122
2002/0017839 A1 * 2/2002 Wei ..... 312/265.1

* cited by examiner

DISPLAY SYSTEM

This application is a continuation-in-part of commonly owned, U.S. patent application Ser. No. 10/113,515 entitled "Display System" filed on Apr. 1, 2002 and now U.S. Pat. No. 6,676,232, expressly incorporated herein by reference.

BACKGROUND OF THE INVENTION

The present invention relates to display systems and structures. More particularly, the present invention relates to a frame structure for holding a plurality of display cases or trays. However, it will be appreciated that the present invention is also amendable to other like applications.

Merchants, particularly those that at trade shows, jewelry shows, coin collector shows, baseball and general sports memorabilia shows, flea markets and the like, are often required to provide their own display cases, structures, trays or the like for presenting their wares to potential customers. Merchants employ all varieties of display cases, structures, trays and the like in showing their goods. For example, some merchants use conventional display cases such as those manufactured by Arizona Case and Allstate Display Case. These types of display cases (FIG. 2) are substantially flat, rectangular boxes having a glass door as an upper side permitting viewing of the contents contained within the display case and openable to provide access to said contents.

One of the problems that is often common to all these merchants at these types of shows is the limited amount of table space provided for showing their goods. That is, a particular merchant is only given a specific amount of table space upon which to place his/her goods. Without more table top surface area, the merchant is limited in the amount of merchandise he/she can display and, therefore, sell. Accordingly, there is a need for a display system that enables more goods to be viewed on a limited amount of table top surface area.

BRIEF SUMMARY OF THE INVENTION

The present invention provides a new and improved display system that overcomes the foregoing difficulties and others and provides the aforementioned and others advantageous features.

In accordance with one aspect of the present invention, a new and improved frame structure is provided. The frame structure includes a first end wall having first and second ends in a top edge. A second end wall is spaced apart from the first end wall and generally parallel orientation relative to the first end wall. The second end wall has first and second ends in a top edge. A pair of side walls extend between the first and second end walls. The first side wall of the pair of side walls is connected at a first end to the first end wall first end and at a second end to the second end wall first end. A second side wall of the pair of side walls is connected at a first end to the first end wall second wall and at a second end to the second end wall second end. The end walls and the side walls define a base cavity. The pair of sidewalls have upper portions that extend a selected distance beyond the top edges of the first and second end walls. A first pair of slide mechanisms is mounted on the upper portions of the pair of side walls. A first slide mechanism of the first pair of slide mechanisms is mounted on the first side wall and a second corresponding slide mechanism of the first pair of slide mechanisms is mounted on the second side wall. A first support is connected to the first pair of slide mechanisms. The first pair of slide mechanisms is capable of slidably moving the first support between a first position wherein anything carried on the first support is positioned over the base cavity obstructing viewing into the base cavity and second position wherein the first support passes over one of the top edges of the first and second end walls thereby not obstructing viewing into the base cavity.

In accordance with another aspect of the present invention, a transportable display system for displaying items that can be readily assembled and disassembled without the use of tools is provided. The display system includes a first side wall and a second side wall releasably connected to the first side wall and spaced apart from the first side wall. The second side wall is capable of readily being disconnected and reconnected to the first side wall without the use of tools thereby enabling the display system to be readily assembled and disassembled for transport thereof. A first region is disposed between the first and second side walls. A first pair of slide members is disposed on the first and second side walls. A first support is connected to the first pair of slide members and is adapted to carry items for display within the first region. The slide members are movable for transporting the items carried on the first support toward a position outside the first region.

In accordance with still another aspect of the present invention, a frame structure for displaying a plurality of items is provided. More particularly, in accordance with this aspect of the invention, the frame structure includes a first end wall having first and second ends in a top edge. A second end wall is spaced apart from the first end wall and generally parallel orientation relative to the first end wall. The second end wall has first and second ends in a top edge. A pair of spaced apart side walls extends between the first and second end walls. The end walls and the side walls define a base cavity. A pair of side walls have upper portions that extend a selected distance beyond at least one of the top edges of the first and second end walls. A first pair of slide mechanisms is mounted on the upper portions of the pair of side walls. A first slide mechanism of the first pair of slide mechanisms is mounted on the first side wall and a second corresponding slide mechanism of the first pair of slide mechanisms in mounted on the second side wall. A first support is connected to the first pair of slide mechanisms and is adapted to carry the first pair of slide mechanisms capable of slidably moving the first support between a first position wherein the first support is positioned over the base cavity and a second position wherein the first support passes over one of the top edges of the first and second end walls.

BRIEF DESCRIPTION OF THE DRAWINGS

The invention may take form in various components and arrangements of components, and in various steps and arrangements of steps. The drawings are only for purposes of illustrating preferred embodiments and are not to be construed as limiting the invention.

DETAILED DESCRIPTION OF THE INVENTION

Figure 1:
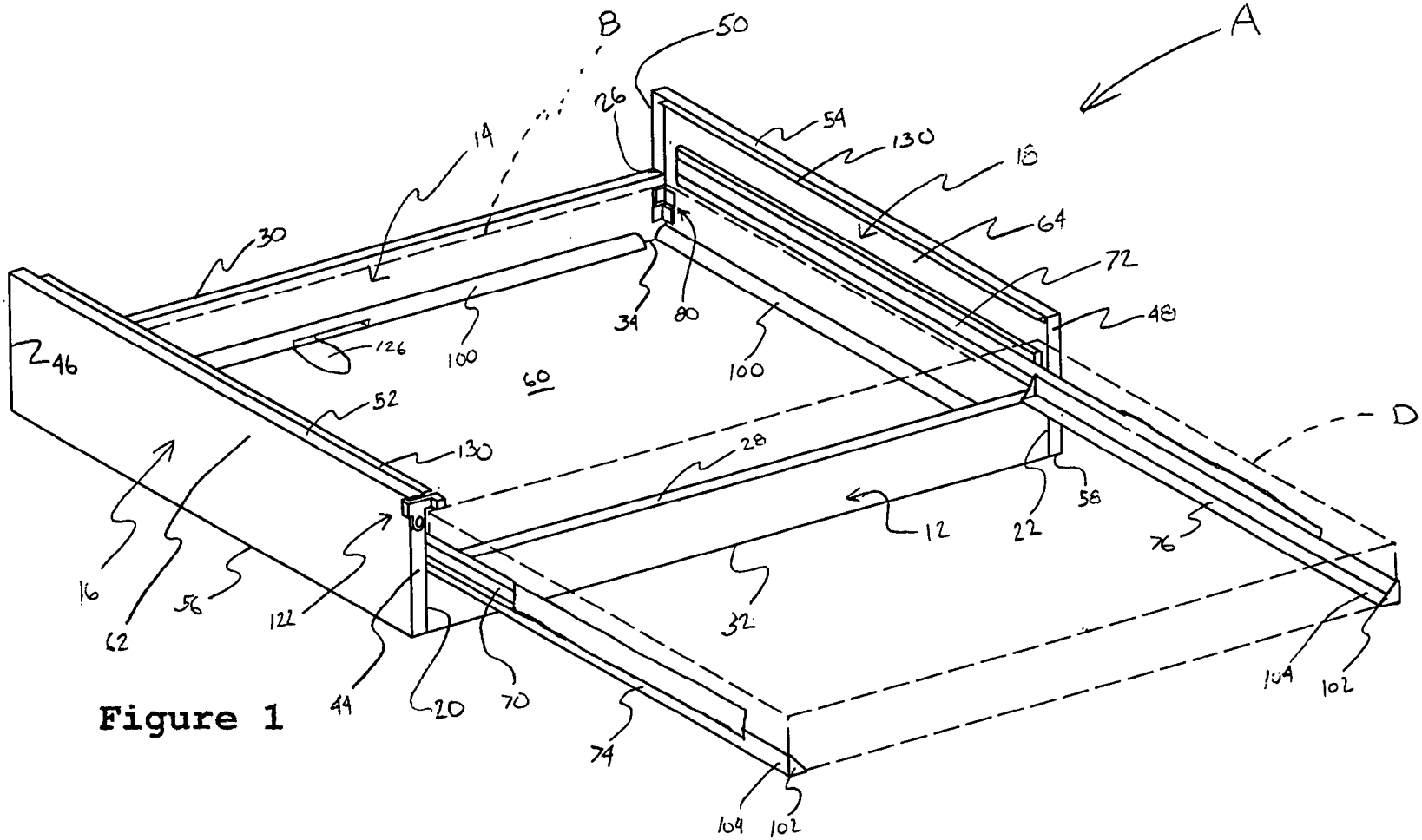
FIG. 1 is a perspective view of a frame structure for holding a plurality of display cases having a first support in an open position in accordance with a first preferred embodiment of the present invention.

Referring now the drawings wherein the showings are for purposes of illustrating the preferred embodiments of the invention only and not for purposes of limiting the same, FIG. 1 shows a display system or frame structure A according to a first preferred embodiment of the present invention. The frame structure A includes a first end wall 12 and a second, opposing end wall 14. The second end wall 14 is spaced apart from the first end wall 12 in generally parallel orientation relative to the first end wall 12. A pair of side walls 16, 18 extend between the first and second end walls 12, 14.

The first end wall 12 includes a first end 20 and a second end 22. The second end wall 14 includes a first end 24 (FIG. 3) and a second end 26. The first end wall 12 further includes a top surface or edge 28 and the second end wall 14 further includes a top surface or edge 30. Additionally, the first end wall 12 includes a bottom surface or edge 32 and the second end wall 14 includes a bottom surface or edge 34.

Together, the first and second end walls 12,14 and the pair of side walls 16, 18 form a rectangular box-shaped structure. The first side wall 16 includes a first end 44 and a second end 46. Likewise, the second side wall 18 includes a first end 48 and a second end 50. The first end 44 of the first side wall 16 connects to the first end 20 of the first end wall 12. The second end 46 of the first side wall 16 connects to the first end 24 of the second end wall 14. The first end 48 of the second side wall 18 connects to the second end 22 of the first end wall 12. The second end 50 of the second side wall 18 connects to the second end 26 of the second end wall 14. The first side wall 16 includes a top surface or edge 52 and the second side wall 18 includes a top surface or edge 54. The first side wall 16 includes a bottom surface or edge 56 and the second side wall 18 includes a bottom surface or edge 58.

The rectangular box-shaped structure defined by the walls 12, 14, 16, 18 defines a base cavity or region 60. In the first preferred embodiment depicted in FIG. 1, the base cavity or region is also defined by a surface (not shown) that the frame structure A may be placed upon. More specifically, such a surface would be generally coplanar with the bottom edges 32,34 of the first and second end walls 12, 14 and the bottom edges 56,58 of the side walls 16, 18. The base cavity 60 is further generally defined by a plane that is generally coplanar with the top edges 28,30 of the first and second end walls 12, 14. The base cavity 60 can be optimally sized for receiving a display case. A display case positioned in the base cavity 60 is referred to herein as a base display case B.

Figure 2:
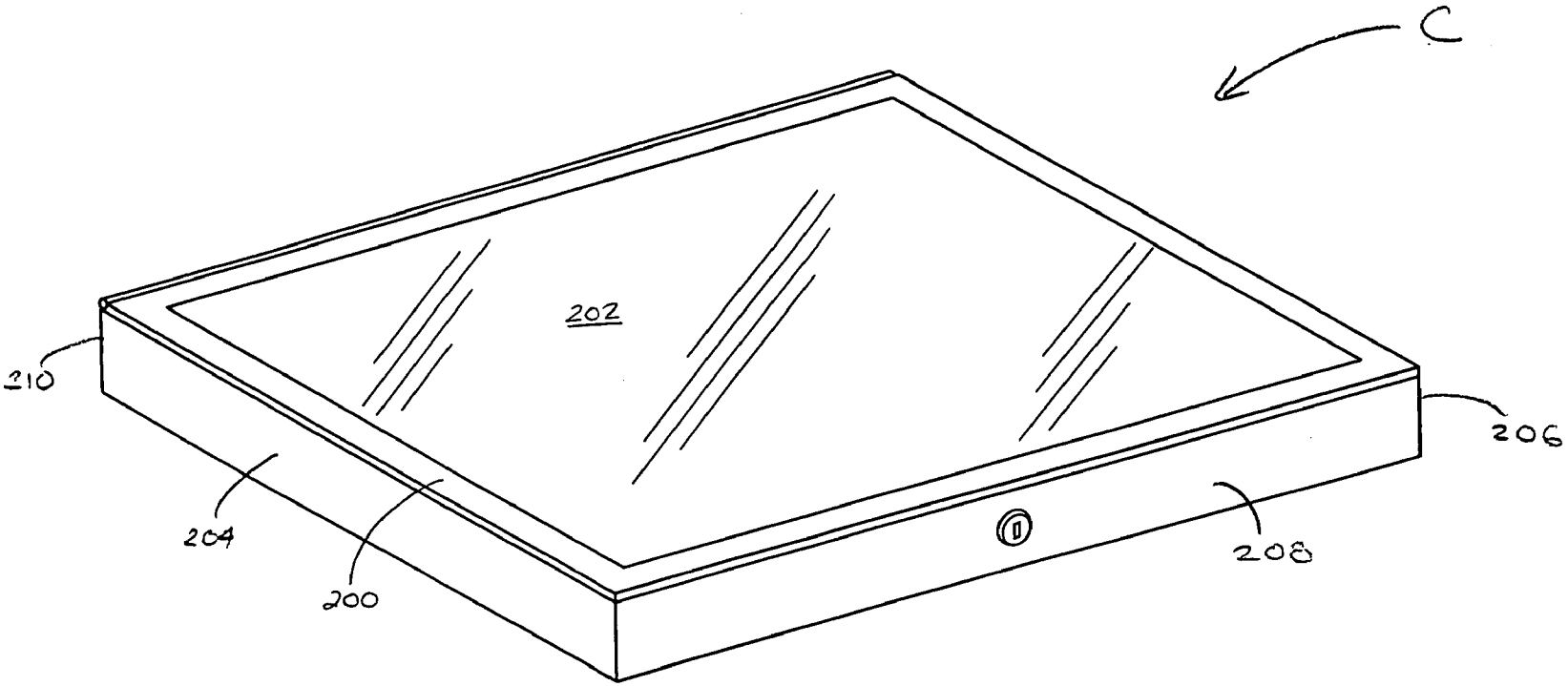
Figure 2 Prior Art
FIG. 2 is a perspective view of a conventional display case.

The display case B may be a conventional display case such as those manufactured by Arizona Case and Allstate Display Case. With reference to FIG. 2, such a conventional display case C is shown. The conventional display case C is a substantially flat rectangular box having an upper side or end 200 that includes a glass portion 202 that permits viewing into a cavity defined by the display case C. The display case C further include lateral sides or edges 204,206, a front side 208 and a rear side 210. The upper end 200 is openable to gain access to the cavity.

Figure 9:
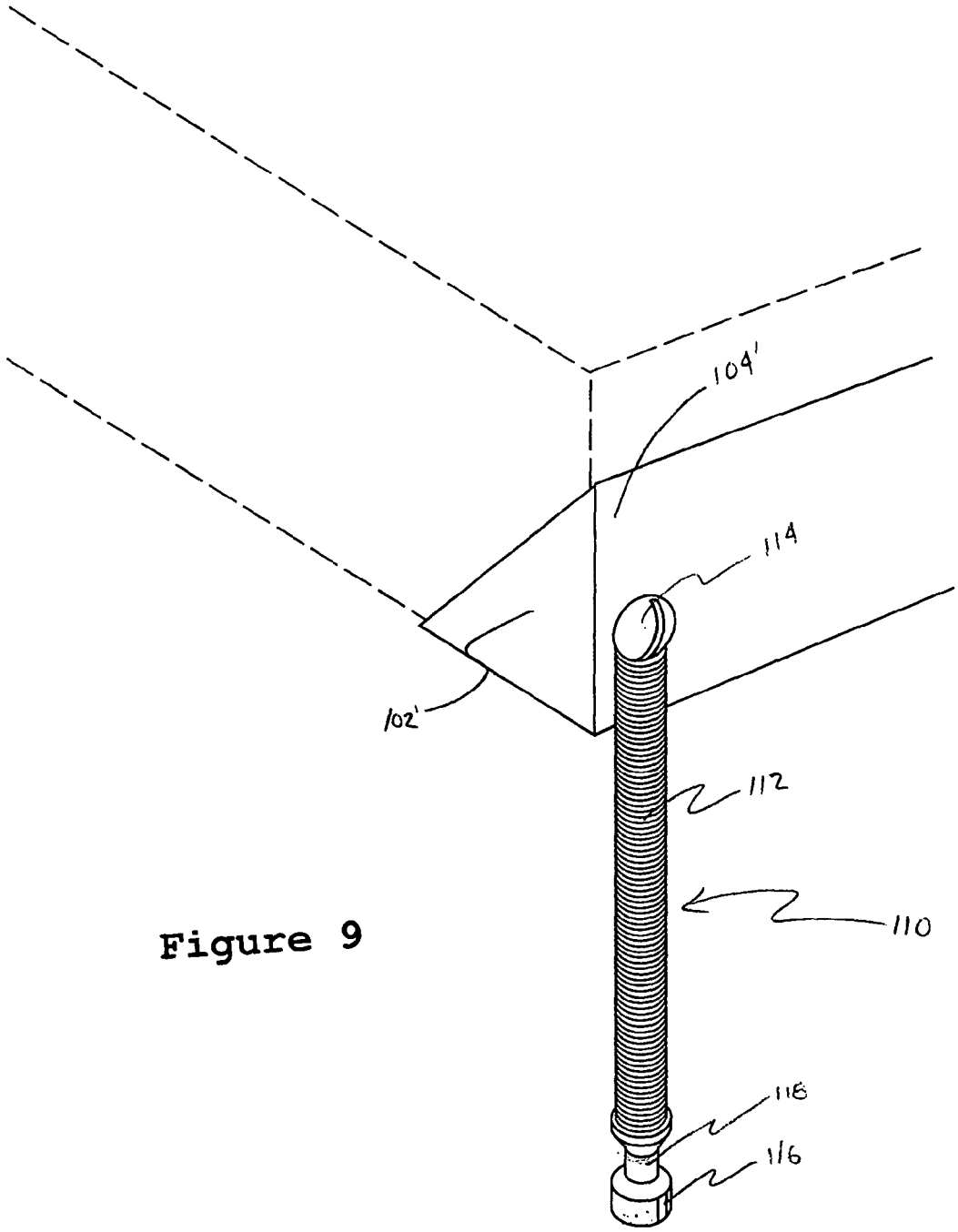
FIG. 9 is an enlarged view of a support device attached to the second support of the frame structure of FIG. 8.

With reference back to FIG. 1, the first side wall 16 includes an upper portion 62 and, likewise, the second side wall 18 includes an upper portion 64. The upper portions 62,64 are generally the portions of the first and second side walls 16, 18 that extend above the top edges 28,30 of the first and second end walls 12, 14. The distance the upper portions 62,64 extend beyond the top surfaces or edges 28,30 is variable. More specifically, the distance the upper portions 62,64 extend beyond the top surfaces 28,30 may be selected or determined depending upon how many display cases the frame structure A is intended to hold. For example, the upper portions 62,64 of the first preferred embodiment shown in FIG. 1 extend a selected distance beyond the top surfaces 28,30 of the first and second end walls 12, 14 to support a single or first display case D above the display case B. Whereas, in a second preferred embodiment shown in FIG. 9, upper portions extend a selected distance beyond top surfaces of first and second end walls to accommodate a pair of stacked display cases D and E.

With continuing reference to FIG. 1, a first pair of slide mechanisms 70,72 are mounted on the upper portions 62,64 of the side walls 16, 18. More specifically, the first slide mechanism 70 is mounted on the first side wall 16 and the second corresponding slide mechanism 72 is mounted on the second side wall 18. The slide mechanisms 70,72 are generally parallel and coplanar with one another. In the first preferred embodiment, the slide mechanisms are shown as being movable over the top edge 28 of the first end wall 12. In alternate embodiments, the slide mechanisms can be modified or substituted such that they are moveable over the top edge 30 at the second end wall 14 or moveable over both top edges 28,30 of the first and second end walls 12, 14.

Figure 4:
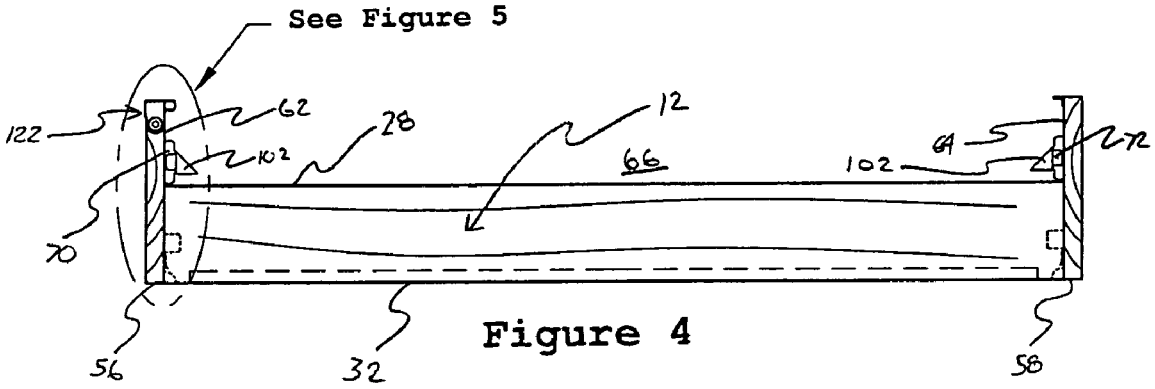
FIG. 4 is a front elevational view of the frame structure of FIG. 1.

With reference to FIG. 4, a first region 66 is defined between the upper portions 62,64. More specifically, with additional reference to FIG. 1, the first region 66 is defined between the respective first ends 44,48 of the first and second side walls 16, 18 and the second ends 46,50 of the first and second side walls 46,50. Additionally, the first region is generally defined between a plane generally parallel to the first and second end wall top edges 28,30 and a plane generally parallel to the first and second side wall top edges 52,54.

The slide mechanisms 70,72 are capable of slidably supporting a first support 74,76 for carrying a display case. The first support 74,76 is constructed of a first track member 74 and a second track member 76. The first and second track members 74,76 are "L" shaped members connected to the first and second slide mechanisms 70,72. The first and second track members 74,76 are capable of supporting the first display case D. More specifically, the slide mechanisms 70,72 are capable of slidably moving the first display case D carried by the first and second track members 74,76 between a first position wherein a first display case D is positioned within the first region 66 substantially obstructing viewing into the base cavity 60 or the base display case B if it is contained within the base cavity 60 and a second extended position wherein the first display case D is slid forward from the frame structure A as shown in FIG. 1. With the first display case D in the second, extended position, the base cavity 60 and/or the base display case B are not substantially obstructed by the first display case D. Thus, viewing into the base cavity 60 of the base display case B (if contained within the base cavity 60) is permitted.

Figure 7:
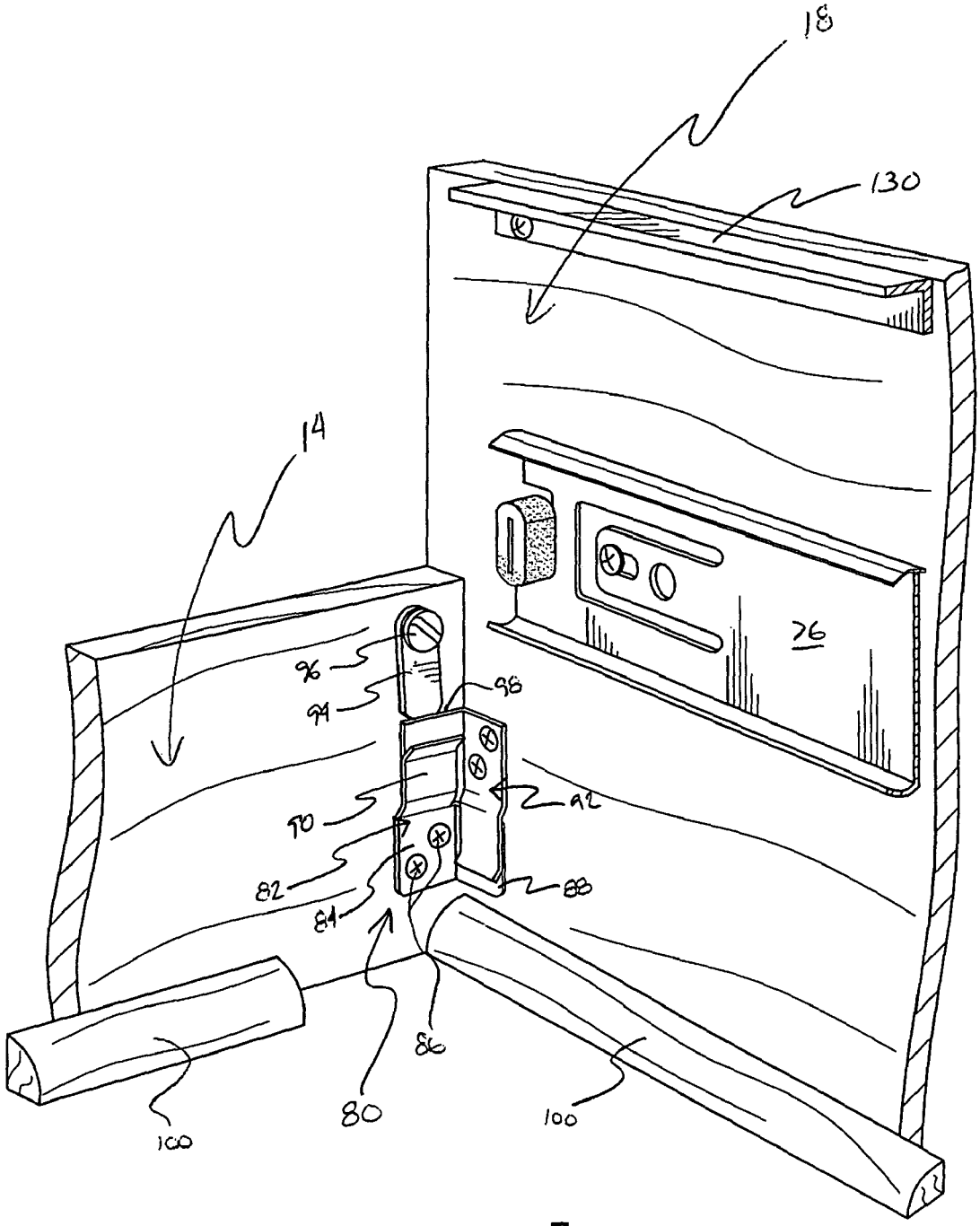
FIG. 7 is a partial enlarged perspective view of the connection between a second end wall and a second side wall of the frame structure of FIG. 1.

The first and second end walls 12, 14 and the first and second side walls 16, 18 are interconnected by a plurality of fastener sets 80. With reference to FIG. 7, each fastener set includes a first fastener member 82. The first fastener member 82 includes a mounting portion 84 having openings therein for receiving screws 86. The screws 86 securely mount the first fastener member 82 to a desired wall such as the second end wall 14 shown in FIG. 7. The first fastener member 82 additionally includes an abutting tab 88 that abuts an adjacent wall such as the first side wall 18 shown in FIG. 7. The first fastener member 82 also includes a receiving tab 90 used to matingly engage with a second fastener member 92. The second fastener member 92 is substantially similar to the first fastener member except that it is inverted. A pivotable lock member 94 is secured to the wall for locking the engagement between the first and second fastener members 82,92. More specifically, the lock member 94, when in a locked position, prevents the first and second fastener members from being disconnected.

Figure 6:
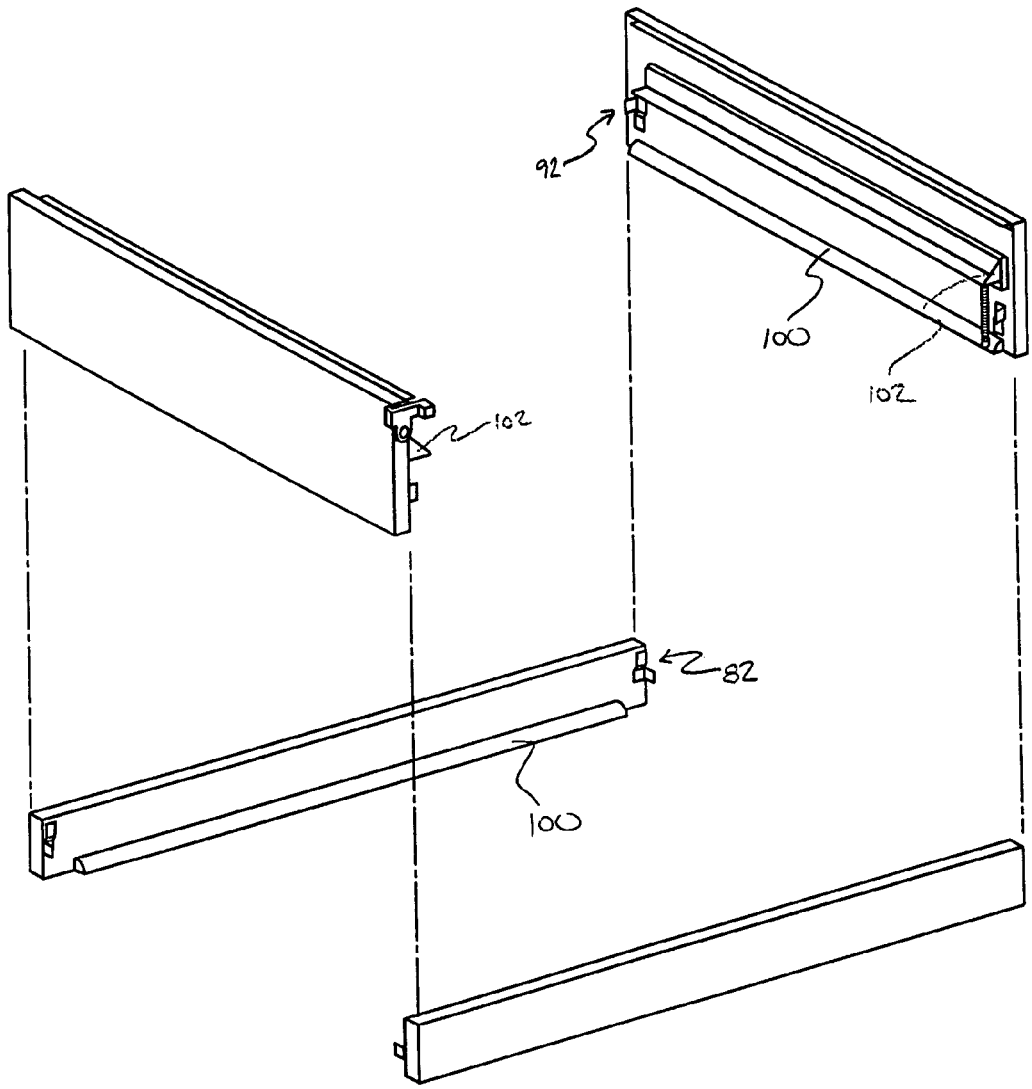
FIG. 6 is an exploded perspective view of the frame structure of FIG. 1.

Each of the plurality of fastener sets 80 work in the same manner as the first and second fasteners 82,92 described herein. With additional reference to FIG. 6, the plurality of fastener sets 80 permit the frame structure to be assembled and disassembled by merely moving the side walls 16, 18 vertically relative to the end walls 12, 14. The fastener sets 80 are readily connectable and disconnectable which permits easy assembly and disassembly of the frame structure A. Thus, no tools are required for connecting and disconnecting the side walls 16, 18 and the end walls 12, 14.

Lock members are used with each fastener set 80 in the first preferred embodiment shown and described herein. The lock members are movable between a locked position such as the position of the lock member 94 shown in FIG. 7 wherein the side walls 16, 18 and the end walls 12, 14 are prevented from being readily disconnected. The lock members are each pivotable or movable to an unlocked position which then permits the walls 12–18 to be disconnected from one another. With specific reference to FIG. 7, the lock member 94 engages the top edge 98 of the inverted fastener member 92.

With reference to FIG. 1, a plurality of base rails 100 are attached to each of the walls 12–18 adjacent respective bottom edges thereof. The base rails 100 are generally quarter round pieces that are used to center the display case B within the cavity 60. In the first preferred embodiment of FIG. 1, base rails 100 are provided along each of the walls 12–18. However, it is to be appreciated that other configurations of base rails 100 are permitted. For example, the base rails 100 may be provided only on the end walls 12, 14 or may only be provided on the side walls 16, 18.

The first support, which is the first and second track members 74,76 in the first preferred embodiment, includes a slide support such as stops or support brackets 102. Support brackets 102 can be positioned at one or both ends of the track members 74,76. The support brackets 102 prevent the carried first display case D from sliding off the track members 74,76 in the direction of the support brackets 102. With specific reference to FIG. 1, the track members 74,76 each include a support bracket 102 positioned at respective front track member ends 104 of the track members 74,76.

Figure 5:
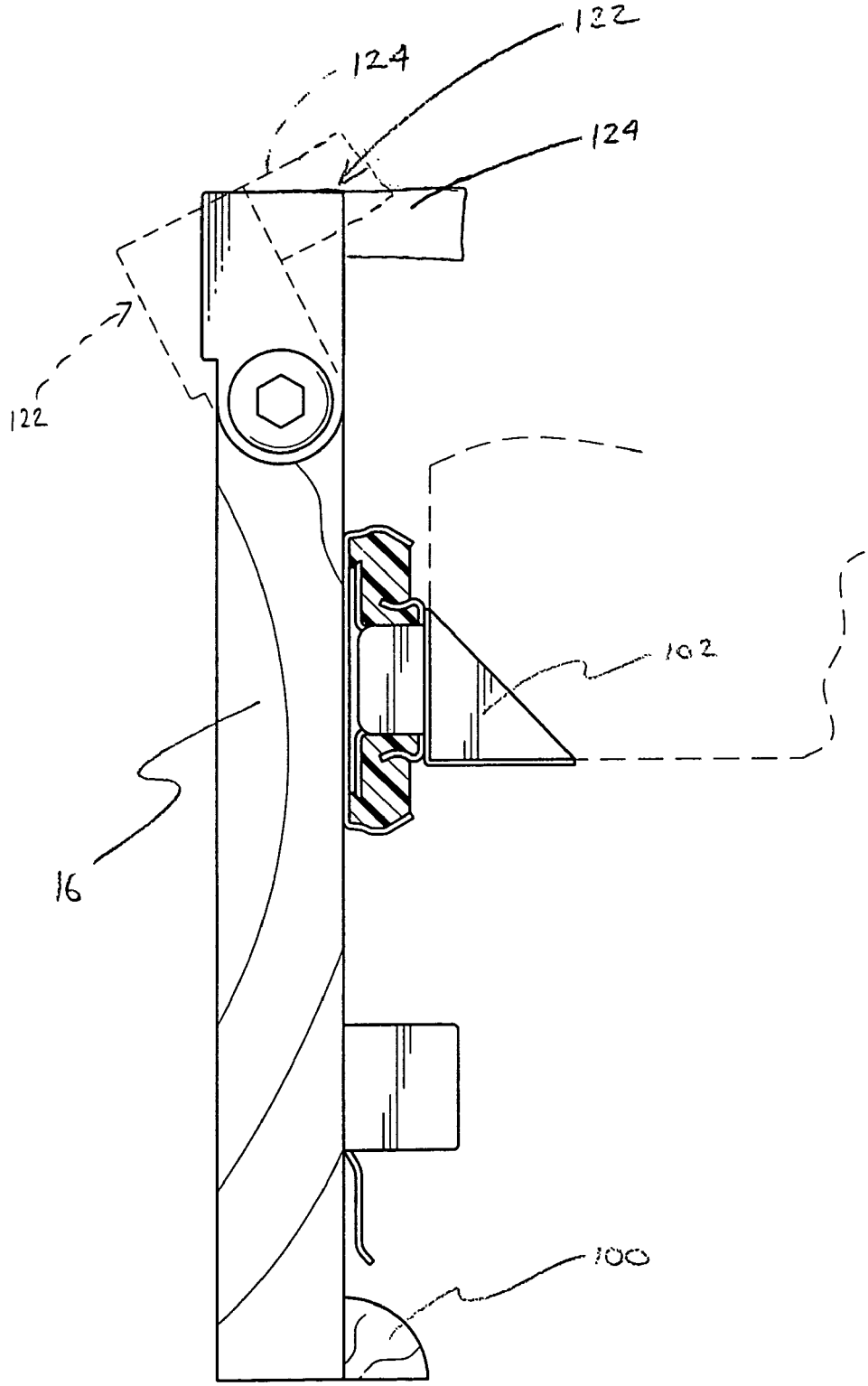
FIG. 5 is a partial enlarged front elevational view of the frame structure of FIG. 1.

With continued reference to FIG. 1, a lock mechanism 122 is provided on the first side wall 16 at the first end 44 thereof adjacent the top surface 52. The lock mechanism is pivotably mounted to the first side wall 44. With additional reference to FIG. 5, the lock mechanism 122 is movable between a first locking position wherein a tab 124 of the lock mechanism 122 protrudes inward relative to the first side wall 16 and a second position wherein a tab 124 does not protrude inward of the first side wall 16.

The lock mechanism is used to lock the first display case D in the first position or in the second extended position. For example, when the first display case D is in the first position adjacent and above the base cavity 60 and within the first region 66, the lock mechanism 122 in the locked position prevents the first display case D from moving toward the second extended position. Upon moving the locked mechanism 122 to the unlocked position, the first display case D can be moved to the second, extended position. When the first display case D is in a second extended position, the lock mechanism 122 can be put into the locked position such as shown in FIG. 1 thereby preventing the first display case D from moving back toward the first position and into the first region 66. Of course, when the lock mechanism is moved to the unlocked position, the first display case D may freely move back to the first position.

Figure 3:
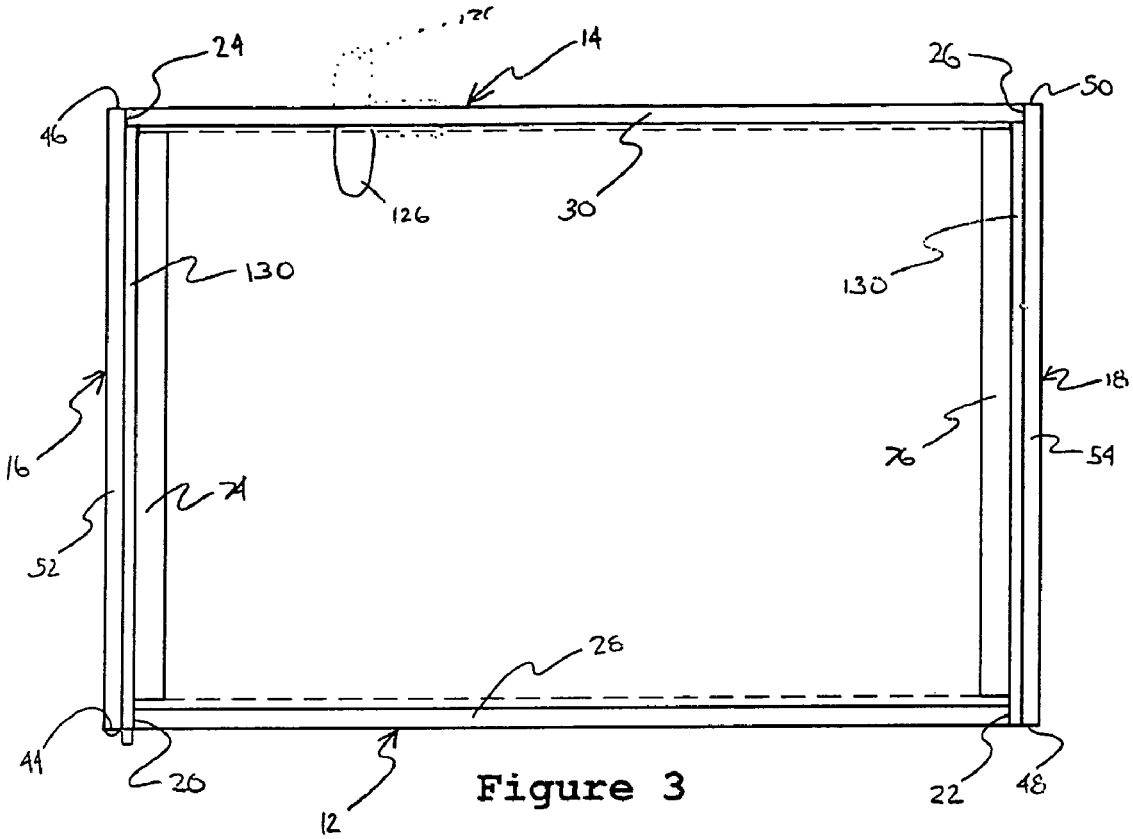
FIG. 3 is a plan view of the frame structure of FIG. 1 showing the first support in a closed position.

The second end wall 14 can optionally include a stabilizer member 126. Stabilizer member 126 is pivotally attached to the bottom edge of surface 34 on the second end wall. The stabilizer member 126 is movable from a position generally parallel to the second end wall 14 to a position wherein the stabilizer member 126 is approximately normal to the second end wall 14. More specifically, the stabilizer member 126 can be pivoted from its parallel position to a position that extends inward in the direction of the first end wall 12 (as shown in phantom in FIG. 1) or can be pivoted to a position that extends outward of the second end wall 14 away from the first end wall 12 (as shown in FIG. 3). When in the position extending inwardly, the stabilizer member 126 will be held in position by the base support case B thereby adding stability to the frame structure A. When in the outward position, the stabilizer member 126 can optionally be held in position by another object positioned adjacent the frame structure A such as another display case C or some other clamping or securing device.

With reference to FIGS. 1 and 7, a gap member 130 is provided on each of the first and second side walls 16,18. With additional reference to FIG. 4, the gap member 130 fills a gap created by the slide mechanisms 70,72. More specifically, the slide mechanisms 70,72 position a carried first display case D slightly away from the first and second side walls 16,18. The gap members 130 serve to fill the gaps created thereby. Alternately, the slide mechanisms 70,72 may be mounted in a manner that eliminates gaps and the need for the gap members 130 between the side walls 16, 18 and the display case D. For example, the side walls 16, 18 could be milled out to define recesses for mounting the slide mechanisms 70,72 flush with the side walls 16, 18.

Figure 8:
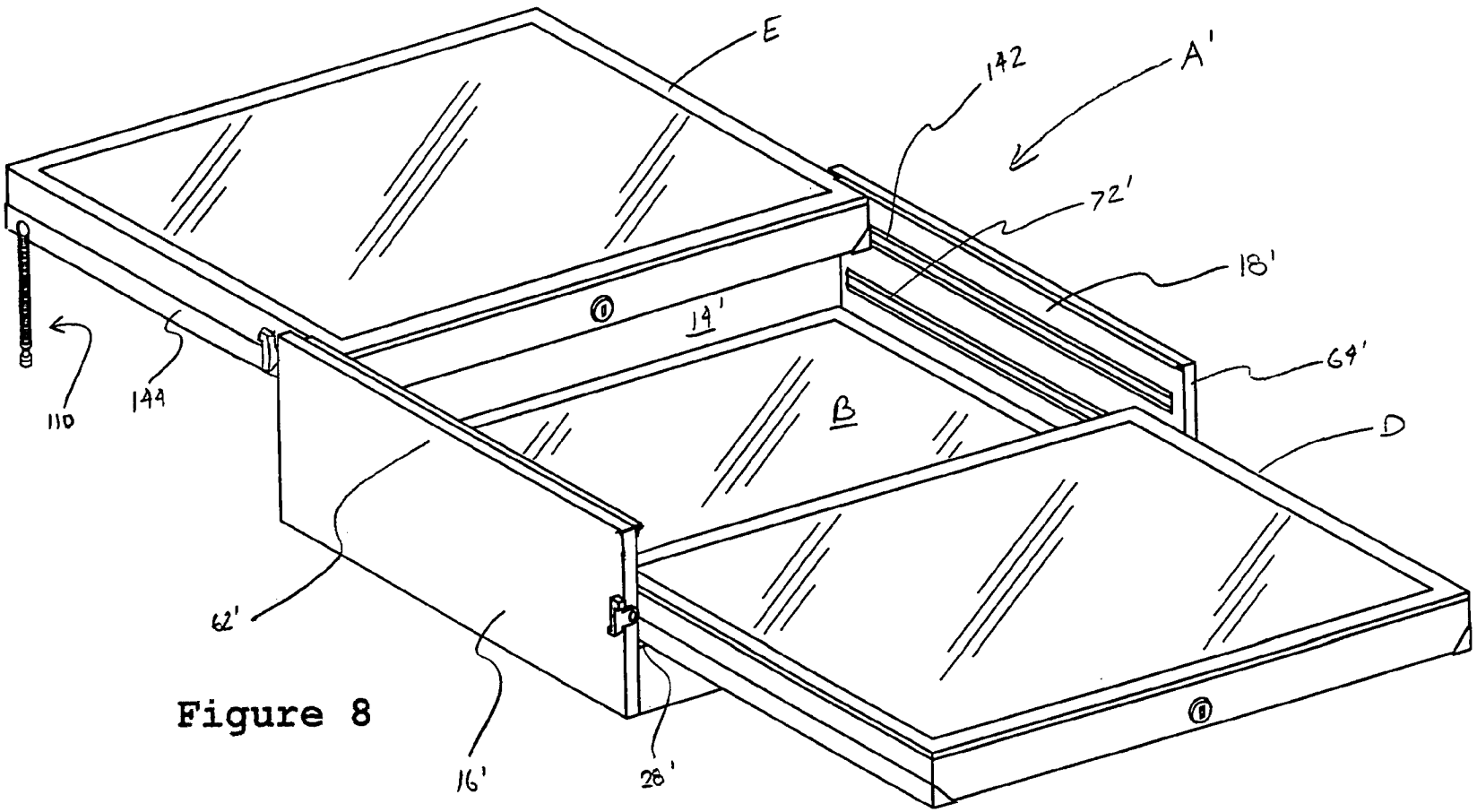
FIG. 8 is a perspective view of a frame structure for holding a plurality of display cases showing a first support in a forward open position and a second support in a rearward open position in accordance with a second preferred embodiment of the present invention.

With reference to FIG. 8, a frame structure A' is shown in accordance with a second preferred embodiment of the present invention. The frame structure A' is similar to the frame structure A of FIG. 1 except that the frame structure A' is adapted to hold three display cases, namely, the base display case B, the first display case D and a second display case E. Pieces or components of the frame structure A' that are the same or similar to pieces of the frame structure A are identified with like reference numerals with a primed (') suffix and new components are defined by new numerals.

More specifically, the frame structure A' includes a pair of side walls 16', 18' that have upper portions 62',64' that extend beyond top surfaces or edges 28',30' a selected distance in order to support the pair of display cases D, E which are above the base display case B. The upper portions 62',64' have a pair of first slide mechanisms 70',72' mounted thereon and a second pair of slide mechanisms 140, 142 mounted thereon. The second pair of slide mechanisms 140,142 are mounted above the first pair of slide mechanisms 70',72'.

A second support 144,146 is connected to the second pair of slide mechanisms 140,142 for carrying the second display case E. The second pair of slide mechanisms 140,142 are capable of slidably moving the second display case E between a first position (not shown) wherein the second display case E would be positioned over the base display case B substantially obstructing viewing into the base display case B or the cavity 60' that the base display case B occupies and a second position wherein the second display case E passes over the top edge 28' of second end wall 14' thereby not substantially obstructing viewing into the base display case B or the base cavity 60'.

The second slide mechanisms 140,142 are mounted a sufficient distance above the first slide mechanisms 70',72' to provide a clearance between the first display case D and the second display case E. The upper portions 62',64' define first region 66' and a second region adjacent and above the first region. The first region 66' receives the first display case D when it is in its first position and the second region receives the second display case E when it is in its first position. It should be appreciated that although the two embodiments shown and described thusfar are only adapted to carry two and three display cases, respectively, it is contemplated that the present invention could be modified to carry any number of display cases.

The second support 144,146 additionally includes a support device 110 for providing support to the carried second display case E when the second display case E is in the extended position. More specifically, the support device 110 extends downward from the second support 144,146. With additional reference to FIG. 9, the support device 110 includes a resilient portion 112, such as a spring, allowing the support device 110 to be flexible. The resiliency provided by the portion 112 is included to limit the ability of the support device 110 from being able to pinch a persons fingers when the second support 144,146 is moved between its first and second positions. The support device 110 is fastened to the second display case support 144,146 by a fastener such as a screw 114. The support device 110 additionally includes a rubber head portion 116 at a distal end thereof and an adjustable section 118 that allows the length of a support device to be adjusted to a desired length.

Additionally, although the first display case D is shown as passing over only the top edge 28 in the first preferred embodiment and 28' in the second preferred embodiment, either embodiment could be modified such that the first display case D is capable of passing over only its top edge 30 or 30' or both its top edges 28, 30 or 28', 30'. Likewise, although the second display case E is shown as passing over only the top edge 30', the second preferred embodiment could be modified such that the second display case E is capable of passing over the top edge 28' or both top edges 28' and 30'.

Another option is contemplated where the display frame A or A' is constructed or positioned at an angle to provide easier viewing of the display case contents by potential customers. For example, the display frame could be constructed so that each display case rests at an angle such as about 15 degrees to about 45 degrees. Such a tilt would be permit better viewing into the display cases.

Figure 10:
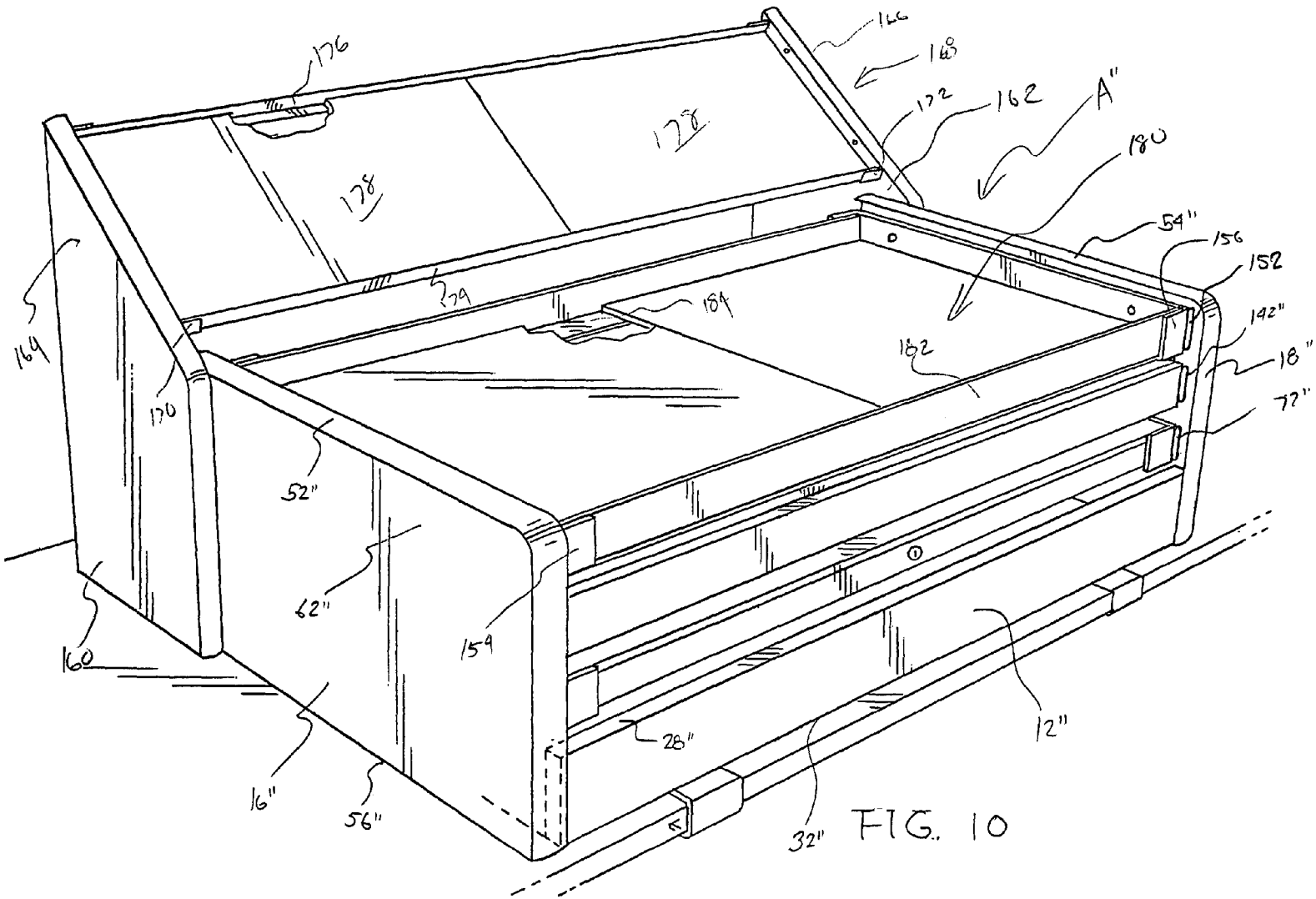
FIG. 10 is a perspective view of a frame structure in accordance with a third preferred embodiment of the present invention.

With reference to FIG. 10, a frame structure A" is shown in accordance with a third preferred embodiment of the present invention. Pieces or components of the frame structure A" that are the same or similar to pieces of the frame structures A and A' are identified by like reference numerals with a double primed (") suffix and new components are defined by new numerals. The frame structure A" includes a pair of side walls 16", 18" that have upper portions 62",64" that extend beyond top surfaces or edges 28",30" a selected distance in order to support three display cases, trays or other display supporting means above base cavity 60". More specifically, with additional reference to FIG. 15, the upper portions 62",64" have first slide mechanisms 70",72", second slide mechanisms 140",142" and third slide mechanisms 150,152 mounted thereon. The second slide mechanisms 140",142" are mounted above the first slide mechanisms 70",72" and the third slide mechanisms 150,152 are mounted above the second slide mechanisms 140",142".

A first support 74,76 is connected to the first slide mechanisms 70",72". A second support 144",146" is connected to the second slide mechanisms 140",144" and a third support 154,156 is connected to the third slide mechanisms 150,152. As will be described in further detail below, any of the supports 74",76"; 144",146" and/or 154,156 can be used to carry a collapsible tray, a collapsible tray case, a conventional display case or other like object. The first slide mechanisms 70",72" are capable of slidably moving the first support 74",76" and anything carried thereon between a first support first position wherein anything carried on the first support 74",76" would be positioned over the base cavity 60" substantially obstructing viewing into the cavity 60" and a first support second position wherein the first support 74",76" passes over the top edge 30" (FIG. 14) of the second end wall 14" thereby not substantially obstructing viewing into the base cavity 60".

The second slide mechanisms 140",142" are capable of slidably moving the second support 144",146" between a second support first position wherein anything carried on the second support 144",146" would be positioned over anything carried on the first support 74",76" if the first support is in the first support first position and substantially obstructing viewing into the cavity 60" and a second support second position wherein anything carried on the second support 144",146" passes over the top edge 30" of the second end wall 14" thereby not substantially obstructing viewing of anything carried on the first support if the first support is in the first support first position or the base cavity 60". Likewise, the third slide mechanisms 150,152 are capable of slidably moving the third support 154,156 between a third support first position wherein anything carried on the third support 154,156 would be positioned over anything carried on the first support 74,76 if in the first support first positions, anything carried on the second support 144",146" if in the second support first position and the base cavity 60" and a second position wherein anything carried on the third support 154,156 passes over the top edge 30" of the second end wall 14" thereby not substantially obstructing viewing of anything carried on the second support 144",146", the first support 74",76" or the base cavity 60".

The second slide mechanisms 140",142" are mounted a sufficient distance above the first slide mechanisms 70",72" to provide a clearance between anything carried on the first support 74",76" and anything carried on the second supports 144",146". Likewise, the third slide mechanisms 150,152 are mounted a sufficient distance above the second slide mechanisms 144",146" to provide a clearance between anything carried on the second support 144",146" and anything carried on the third supports 154",156".

The upper portions 62",64" define a first region 66", a second region adjacent and above the first region, and a third region adjacent and above the second region 108". The first region 66" generally includes the area between the upper portions 62",64" that is above the edges 28",30" and below the second slide mechanisms 140",142" and receives anything carried on the first supports 74",76" when the first support is in the first support first position. The second region 108" generally includes the area between the upper portions 62",64" that is above the first slide mechanisms 70",72" and below the third slide mechanisms 150,152 and receives anything carried on the second support 144",146" when the second support is in the second support first position. The third region 158 generally includes the area between the upper portions 62",64" that is above the second slide mechanisms and below edges 52",54" and receives anything carried on the third support 154,156 when the third support is in the third support first position. As discussed with reference to the first and second preferred embodiments, it should be appreciated that although the third preferred embodiment is shown and described as adapted to have three supports, it is contemplated that the present invention could be modified to carry any number of supports.

In place of the stabilizer member 126 of the frame structure A in FIG. 1, the frame structure A" includes a pair of stabilizer walls 160, 162. With additional reference to FIG. 17, the stabilizer walls 160,162 connect to the side walls 16", 18" via fastener members 82",92". More particularly, two sets of fastener members can be used to removably attach the stabilizer walls 160,162 to each of the respective side walls 16", 18". The stabilizer walls 160,162, also referred to herein as an anti-tipping device, prevent the frame structure A" from tipping when the slide mechanisms are moved to their open extended positions. Alternatively, a stabilizer member similar to the stabilizer member 126 of the first preferred embodiment can be used in addition to or instead of the stabilizer walls 160,162.

The stabilizer walls 160",162" include upper portions 164,166 for holding an open display tray 168. The open display tray is formed of a pair of supports 170,172 each attached to respective stabilizer walls 160,162. L-shaped members 174,176 are spaced apart and extend across and between the supports 170 and 172. The L-shaped members 174,176 are adapted to receive and support one or more substantially planar walls 178. The display wall 178 can be used for supporting or carrying goods or wares a merchant desires to display to potential consumers.

Figure 11:
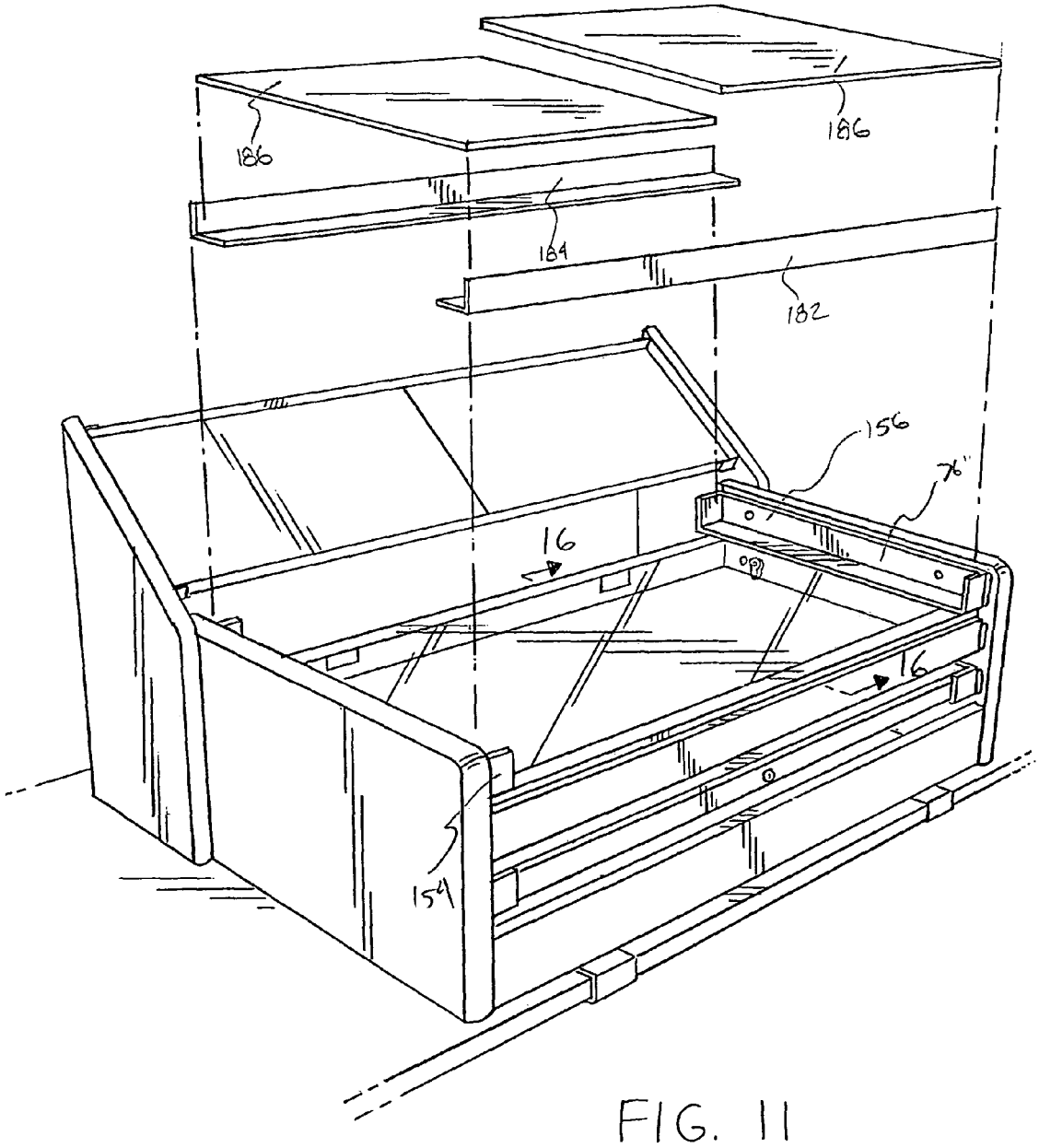
FIG. 11 is a partially exploded perspective view of the frame structure of FIG. 10 showing components of an upper tray carried on a third support of the frame structure.

With reference to FIG. 11, a collapsible display tray 180 is provided for displaying goods or wares. The collapsible display tray 180 forms integrally with the support 154,156 carried by the third slide mechanisms 150,152. The display tray 180 includes L-shaped members 182,184 and one or more substantially planar bottom walls 186. The L-shaped members 182 and 184 are positioned within the members 154,156 of the third support and are spaced apart relative to one another. The bottom walls 186 are then held between the L-shaped members 182,184 and the third support members 156,158. The bottom wall 186 and the L-shaped members 182,184 combine to provide a rigid display tray that prevents the slide members 150, 152 from moving substantially independently relative to one another. Thus, the collapsible display tray 180 may be readily assembled or disassembled. It should be understood that the collapsible display tray 180 could also be used in the first and/or second sets of supports 74",76" and 144",146".

Figure 12:
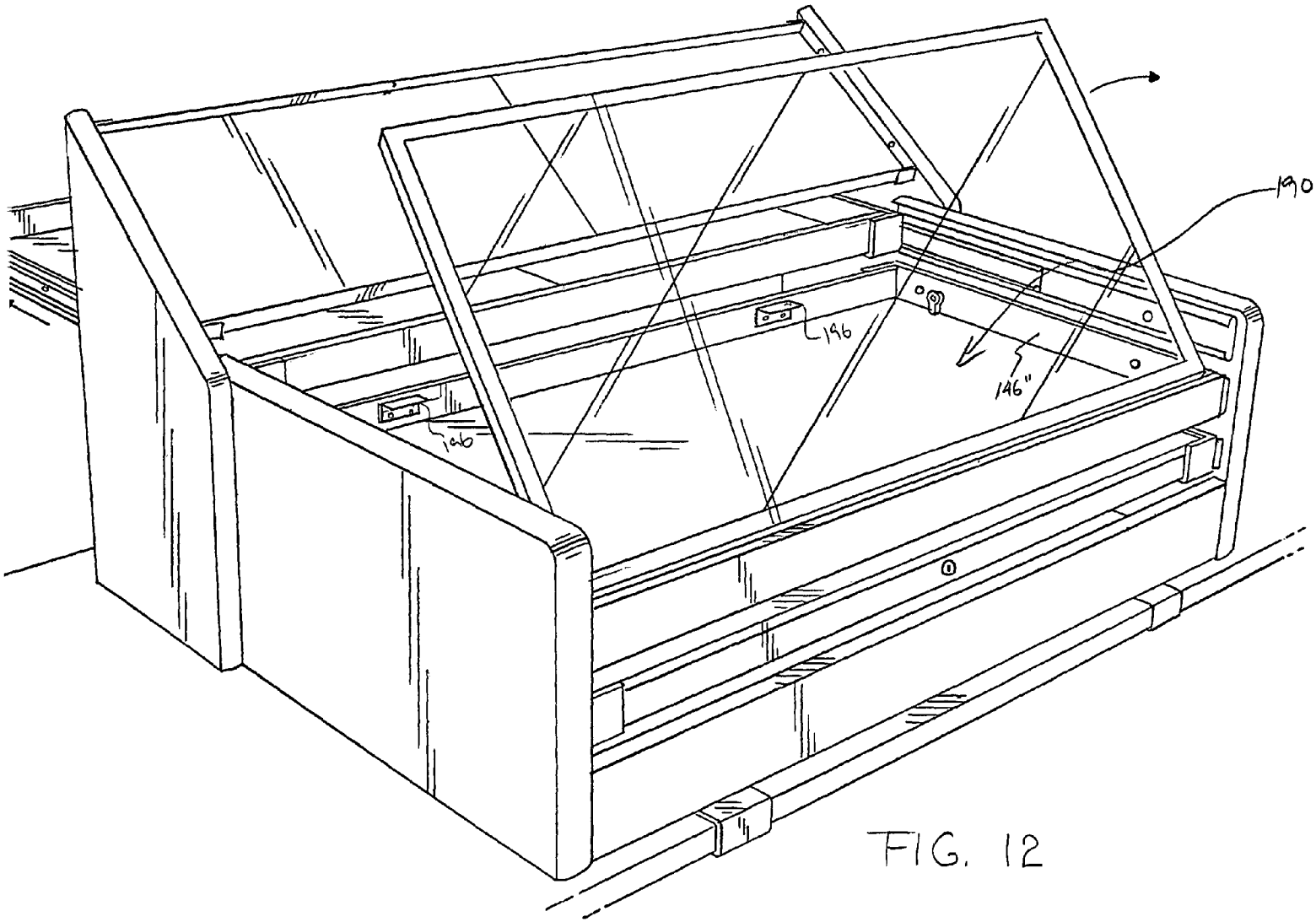
FIG. 12 is a perspective view of the frame structure of FIG. 10 showing a collapsible display case carried on a second support of the frame structure.
Figure 13:
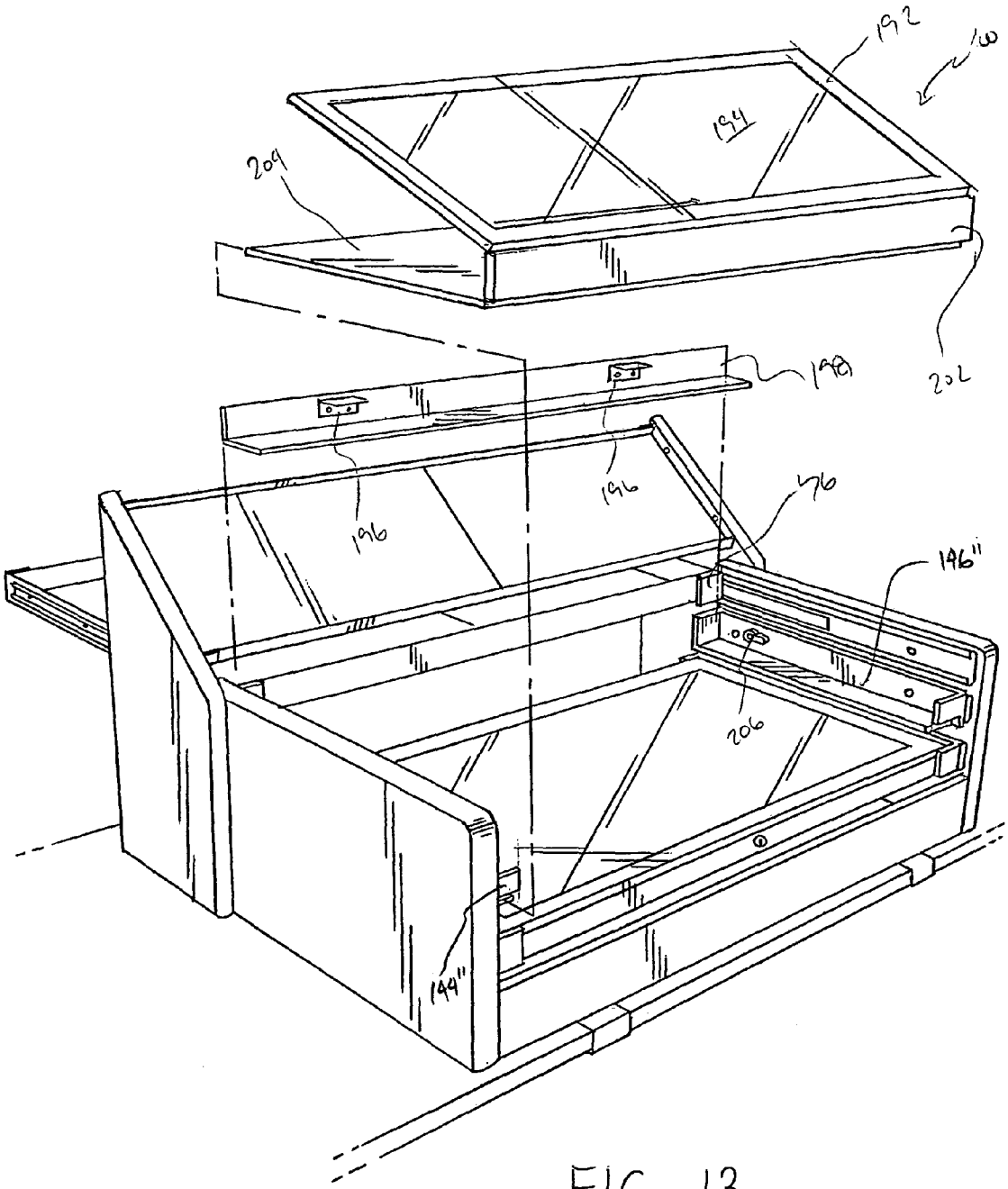
FIG. 13 is a partially exploded view of the frame structure of FIG. 12 showing components of the collapsible display case.
Figure 16:
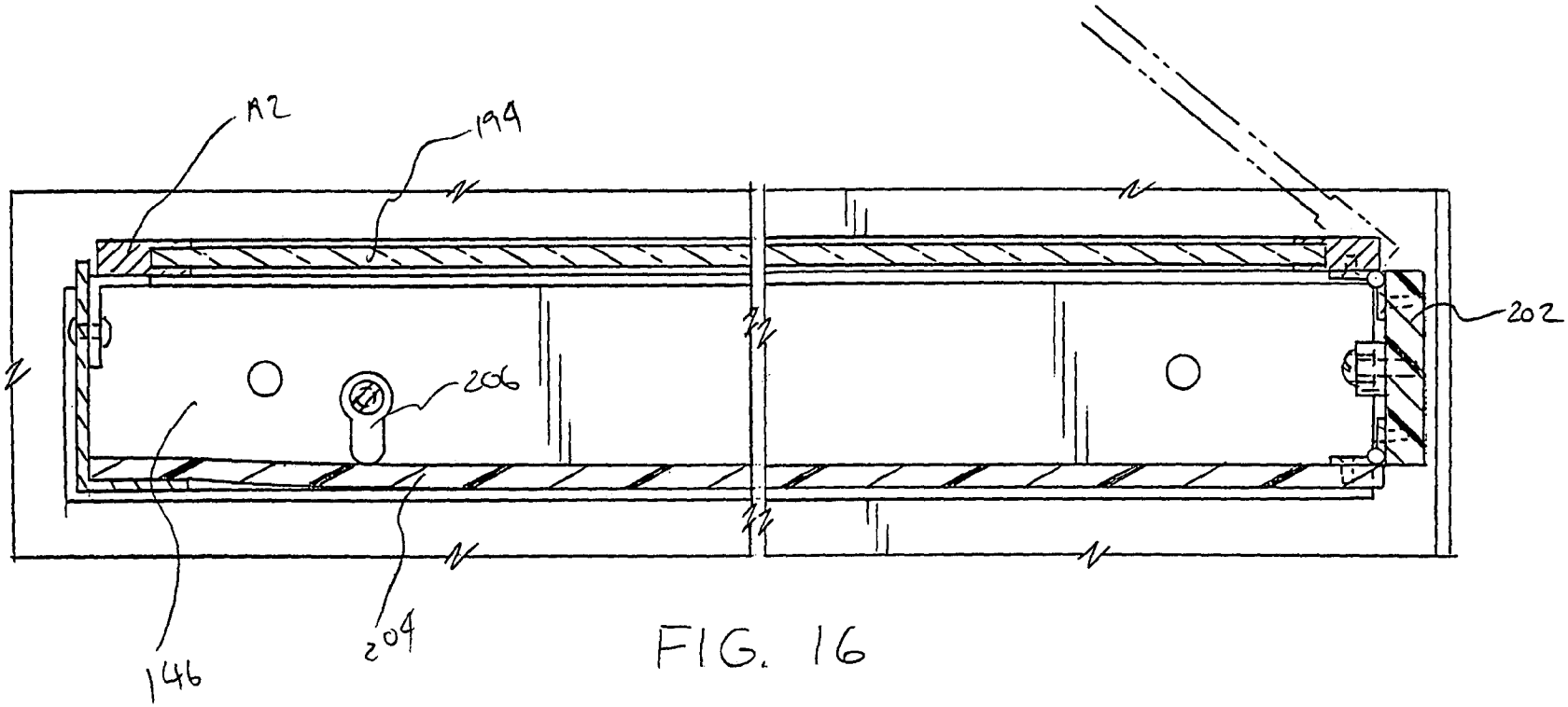
FIG. 16 is a partial cross sectional view of the frame structure taken along the line 16—16 of FIG. 11.

With reference to FIG. 12, a collapsible display case 190 is shown formed integrally with the members 144",146" of the second support. The collapsible display case 190 includes a top 192 having a transparent portion 194 through which one can see the contents of the display case 190. The top 192 rests on supports 196 when the top 192 is in a closed position. With additional reference to FIGS. 13 and 16, the collapsible display case 190 includes an L-shaped member 198 positioned in and between the second support members 144",146" adjacent the rear end wall 14". The L-shaped member 198 includes the supports 196. The display case 190 further includes a display case section 200 including the top 192, a front wall 202 to which the top 192 is pivotally connected and a bottom wall 204 to which the front wall is pivotally connected. The support members 144",146" form side walls of the collapsible display case 190.

Figure 15:
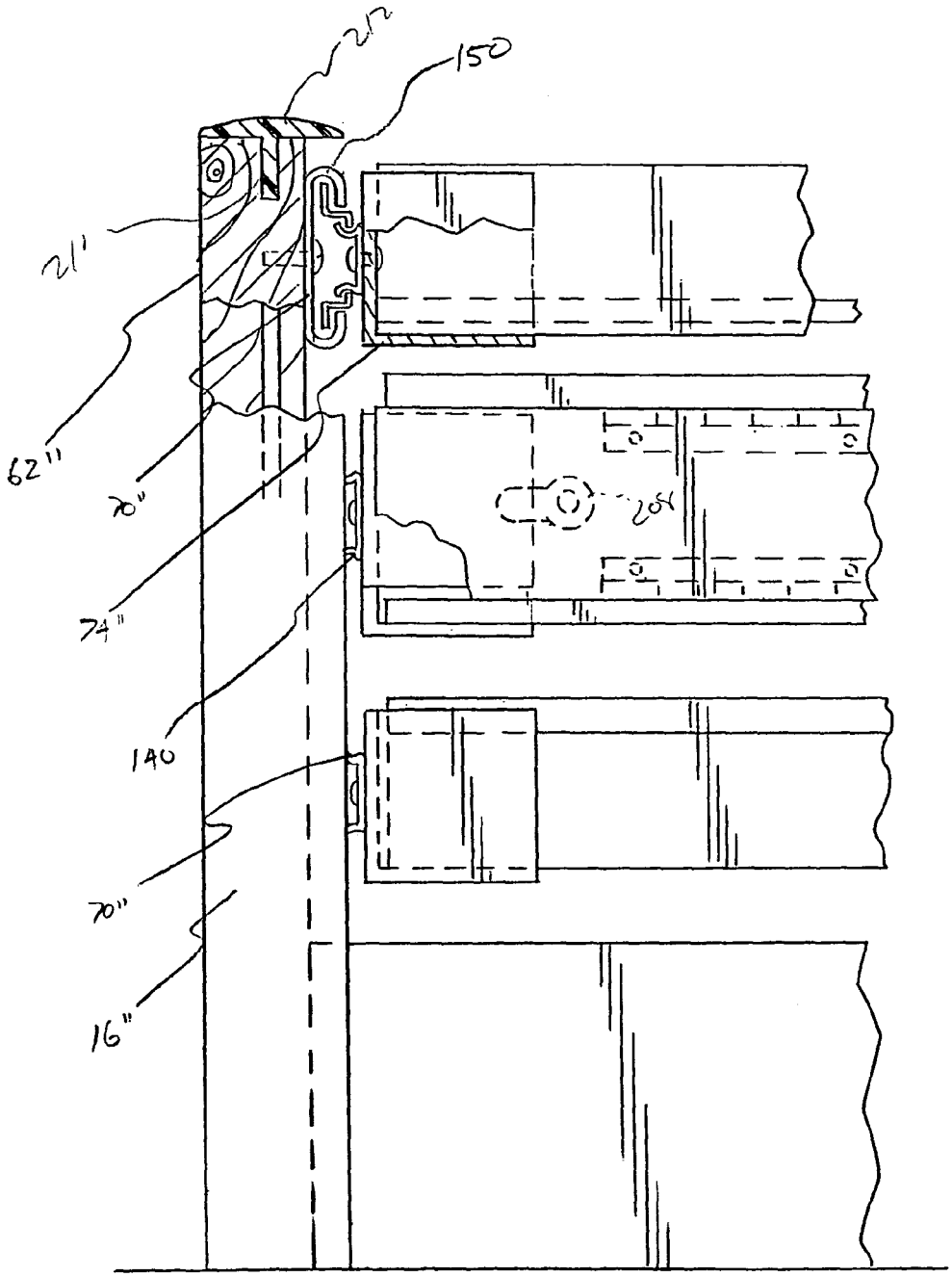
FIG. 15 is a partial elevational view of the frame structure of FIG. 10.

Pivotal locks 206 are disposed on the supports 144",146" for locking the bottom wall 204 in position on the supports 144",146" and, with reference to FIG. 15, pivotal locks 208 are disposed on the wall 202 for securing the wall 202 to the supports 144",146". Although not shown, a locking device can be provided on the display case 190 for locking the top 192 in a closed position. The locking device can be a conventional key operated lock or can be a simple pivoting member that obstructs opening of the top when in a locked position and pivots to an unlocked position. Although the collapsible display case 190 is only shown and described in the second support 144",146", it is to be appreciated that the collapsible display case 190 or multiple collapsible display cases could be adapted for use in one or more of the supports 74",76"; 144",146"; and/or 154,156.

Figure 14:
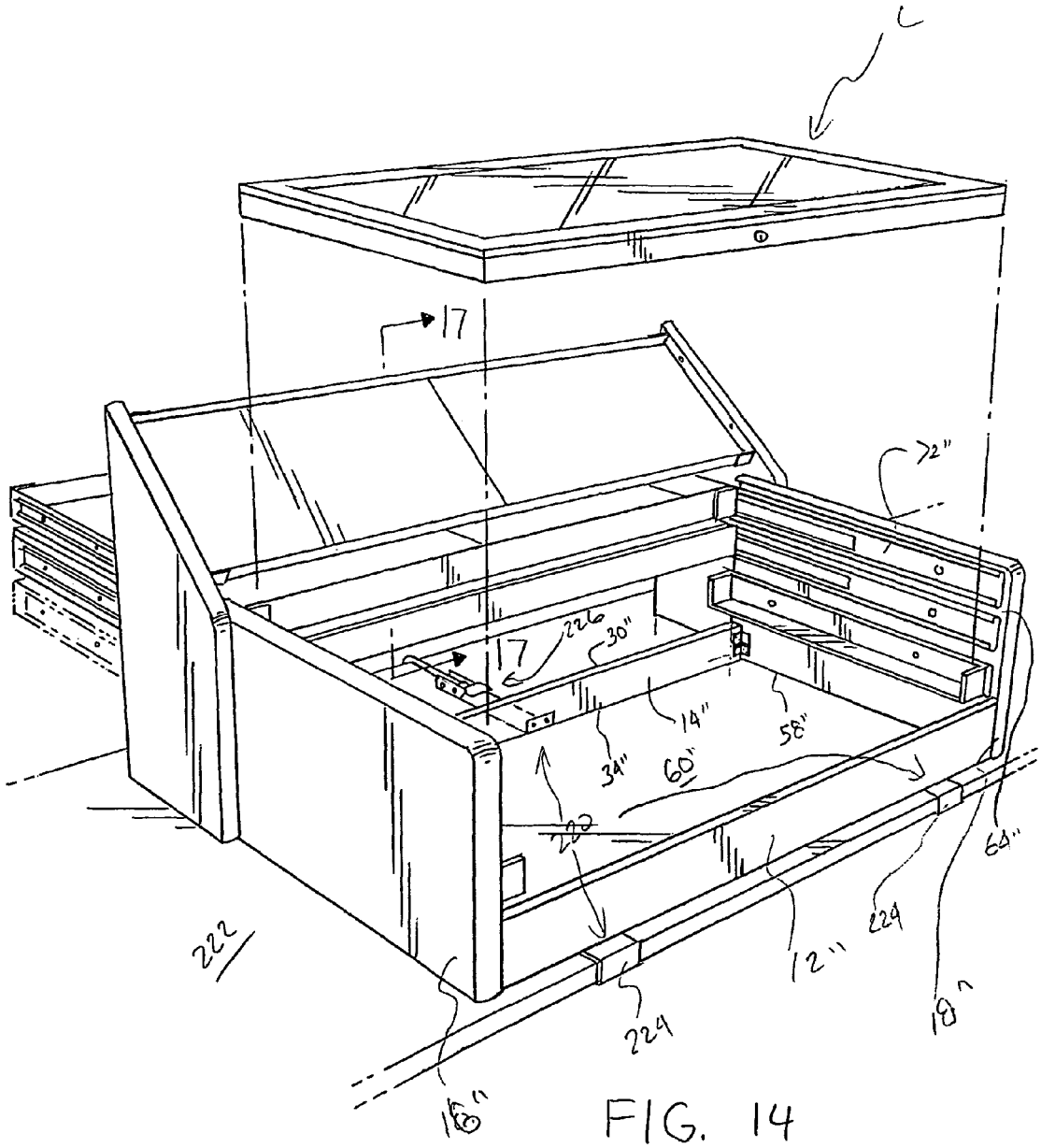
FIG. 14 is a perspective view of the frame structure of FIG. 10 showing a conventional display case carried on a first support of the frame structure.

With reference to FIG. 14, a conventional display case, such as display case C described above, is carried by the first support 74",76". As described in the first preferred embodiment, the display case rests on the first support members 74",76" and provides secure storage for showing goods. As with the collapsible display tray 180 and the collapsible display case 190, conventional display cases could be adapted for use with one or more of the supports 74",76"; 144",146"; and/or 154,156.

With reference to FIG. 15, the side walls 16", 18" include a slot 210 for receiving a gap member 212. The gap member 212 serves the purpose of providing an appearance defining edge along the first and second side wall top edges 52",54" and hides the gap between the supports and their respective slide mechanisms. Of course, other types of gap members could be employed and all similar functioning gap members are to be considered within the scope of the present invention.

Figure 17:
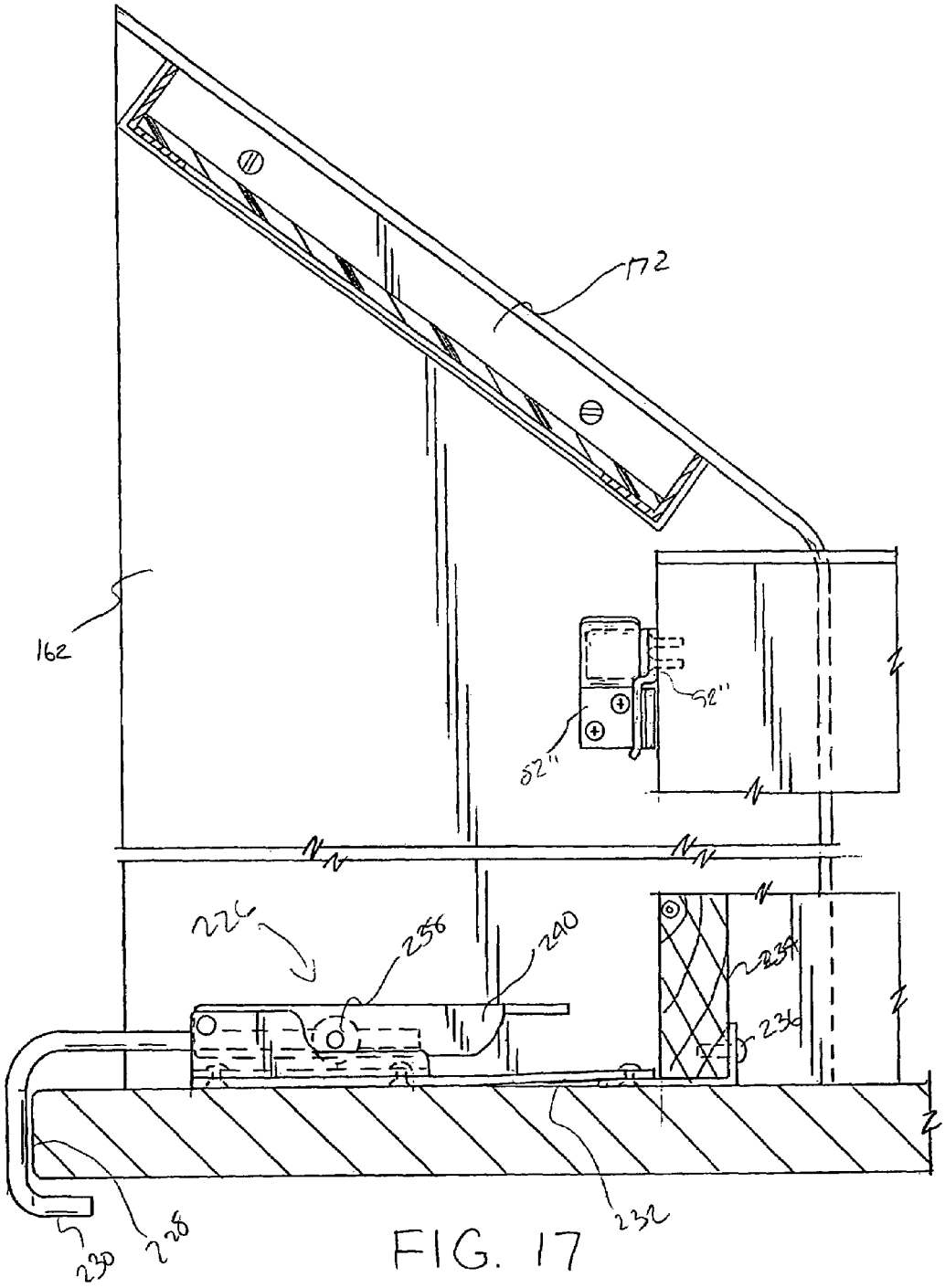
FIG. 17 is a partial cross sectional view of the frame structure taken along the line 17—17 of FIG. 14.

With reference to FIGS. 14 and 17, a latching assembly 220 can be provided in addition to or instead of the stabilizer walls 160,162. The latching assembly 220 maintains the display structure A" on a supporting surface 222, particularly when one or more of the slide mechanisms are extended toward their respective second positions. The latching assembly 220 includes U-shaped brackets 224 connected to the end wall 12". Alternately, the U-shaped brackets 224 could be connected to the side wall 16", 18" adjacent the front wall 12". The latching assembly 220 further includes a tensioning clamp 226. The tensioning clamp holds the rear end wall 14" against a rear edge 228 of the supporting surface 222. More specifically, the tensioning clamp 226 includes a hook member 230 shaped to wrap around the rear edge 228 and an L-shaped member 232 for passing along the bottom edge 34" of the rear end wall 14" and abutting against an inner side 234 of the rear end wall 14". Optionally, the L-shaped member 232 can be fastened directly to the inner side 234 with a suitable fastener such as a screw 236. A conventional tensioning device 238 with a handle 240 is provided for applying and releasing a tension between the display structure A" and the supporting surface 222 via the hook member 230 and the L-shaped member 232. Of course, other means for preventing the walls 12–18 from lifting from the supporting surface are contemplated and are to be considered within the scope of the present invention. For example, a sliding member could be provided in one or both of the side walls that selectively extends outwardly to stabilize the frame structure and retracts when the frame structure is transported.

The invention has been described with reference to the preferred embodiments. Obviously, modifications and alternations will occur to other upon reading and understanding the preceding detailed description. It is intended that the invention be construed as including all such modifications and alterations insofar as they are within the scope of the appended claims or the equivalents thereof.

Having thus described the preferred embodiments, the invention is now claimed to be:

1. A frame structure comprising:

a first end wall having first and second ends and a top edge;

a second end wall spaced apart from the first end wall in generally parallel orientation relative to the first end wall, the second end wall having first and second ends and a top edge;

a pair of sidewalls extending between the first and second end walls, a first sidewall of the pair of sidewalls removeably connected to the first end wall and the second end wall, a second sidewall of the pair of sidewalls removeably connected to the first end wall which is spaced from said first sidewall and to the second end wall which is spaced from said first sidewall, the end walls and sidewalls defining a base cavity, the pair of sidewalls having upper portions that extend a selected distance beyond the top edges of the first and second end walls;

a first pair of slide mechanisms mounted on the upper portions of the pair of sidewalls, a first slide mechanism of the first pair of slide mechanisms mounted on the first sidewall and a second corresponding slide mechanism of the first pair of slide mechanisms mounted on the second sidewall; and a first support connected to the first pair of slide mechanisms, the first pair of slide mechanisms capable of slidably moving the first support between a first position wherein one or more items carried on the first support are positioned between the first pair of slide mechanisms and over the base cavity and a second position wherein the first support passes over one of the top edges of the first and second end walls thereby moving the one or more carried items therewith.

2. The frame structure of claim 1 further comprising:

a second pair of slide mechanisms mounted on the upper portions of the pair of sidewalls above the first pair of slide mechanisms, a first slide mechanism of the second pair of slide mechanisms mounted on the first sidewall and a second corresponding slide mechanism of the second pair of slide mechanisms mounted on the second sidewall; and a second support connected to the second pair of slide mechanisms, the second pair of slide mechanisms capable of slidably moving the second support between (1) a first position wherein one or more items carried on the second support are positioned between the second pair of slide mechanisms and over the first support when the first support is in the first position and the base cavity and (2) a second position wherein the second support passes over one of the top edges of the first and second end walls thereby moving the one or more items carried by the second support therewith, the second pair of slide mechanisms mounted on the upper portions a sufficient distance above the first pair of slide mechanisms to provide clearance between the second support and the first support.

3. The frame structure of claim 1 wherein the first support carries a collapsible display tray including a front wall removable from said first support, a rear wall removeable from said first support, sides formed integrally with the first support and a base wall removeable from said first support.

4. A frame structure comprising:

a first end wall having first and second ends and a top edge;

a second end wall spaced apart from the first end wall in generally parallel orientation relative to the first end wall, the second end wall having first and second ends and a top edge;

a pair of sidewalls extending between the first and second end walls, a first sidewall of the pair of sidewalls removeably connected to the first end wall and the second end wall, a second sidewall of the pair of sidewalls removeably connected to the first end wall spaced from said first sidewall and to the second end wall spaced from said first sidewall, the end walls and sidewalls defining a base cavity, the pair of sidewalls having upper portions that extend a selected distance beyond the top edges of the first and second end walls;

a first pair of slide mechanisms mounted on the upper portions of the pair of sidewalls, a first slide mechanism of the first pair of slide mechanisms mounted on the first sidewall and a second corresponding slide mechanism of the first pair of slide mechanisms mounted on the second sidewall;

a first support carrying a box-shaped display case having transparent viewing wall on a top side thereof connected to the first pair of slide mechanisms, the first pair of slide mechanisms capable of slidably moving the first support between a first position wherein items carried on the first support are positioned over the base cavity and a second position wherein the first support passes over one of the top edges of the first and second end walls.

5. The frame structure of claim 4 wherein the display case is collapsible and integrally formed with the first support.

6. The frame structure of claim 1 further comprising:

a plurality of fasteners for connecting the first end of the first sidewall to the first end wall first end and the second end of the first sidewall to the second end wall first end and for connecting the first end of the second sidewall to the first end wall second end and the second end of the second sidewall to the second end wall second end, wherein the plurality of fasteners are readily connectable and disconnectable permitting assembly and disassembly of the frame structure.

7. The frame structure of claim 6 wherein the fasteners do not require tools for connecting and disconnecting the sidewalls and end walls.

8. The frame structure of claim 6 further comprising:

lock members pivotally movable between a locked position preventing connected sidewalls and end walls from being readily disconnected by preventing disengagement of slidably connected fasteners used to connect said sidewalls and end walls and an unlocked position allowing connected sidewalls and end walls to be readily disconnected by allowing slidable disengagement of said slidably connected fasteners.

9. The frame structure of claim 1 further including a means for preventing one or more of the end walls and sidewalls from lifting from an associated support surface when the first support is moved toward the second position.

10. The frame structure of claim 9 wherein the means for preventing walls from lifting is a pair of support walls extending from one of the first and second end walls along a supporting surface upon which at least one of said sidewalls and said end walls is resting.

11. The frame structure of claim 10 wherein the support walls include a means for supporting a collapsible display tray for displaying items on a side of said one of the first and second end walls opposite said first support.

12. The frame structure of claim 9 wherein the means for preventing walls from lifting is a bracket that engages the associated support surface adjacent the first end wall and an adjustable tension clamp that engages the associated support surface adjacent the second end wall and holds the end walls against the associated support surface.

13. The frame structure of claim 9 wherein the means for preventing walls from lifting is a pivotable stabilizing member connected to a base surface of one of the first end wall, the second end wall, the first sidewall and the second sidewall, said stabilizing member pivotally moveable along a plane of a supporting surface upon which the frame structure is resting.

14. The frame structure of claim 9 wherein the means for preventing walls from lifting is a slidable member that extends outwardly from one of the first and second end walls to prevent tipping and retracts when not in use.

15. The frame structure of claim I further comprising a gap member connected to at least one of the upper portions above one of the first and second slide mechanisms for at least partially covering a space between said first support and one of said pair of sidewalls.

16. A transportable display system for displaying items that can be readily assembled and disassembled without the use of tools, comprising:

a first sidewall;

a second sidewall releasably and threadlessly connected to the first sidewall and spaced apart from the first sidewall, the second sidewall capable of being readily disconnected and reconnected to the first sidewall without the use of tools thereby enabling the display system to be readily assembled and disassembled for transport thereof;

a first region disposed between the first and second sidewalls;

a first pair of slide members disposed on the first and second sidewalls;

a first support connected to the first pair of slide members and adapted to carry items for display within the first region, the slide members movable for transporting the items carried on the first support toward a position outside the first region; and an anti-tipping device connected to at least one of the first and second sidewalls that prevents separation from an associated support surface when the first support is moved to the position outside the first region.

17. The display system of claim 16 wherein a base region is disposed adjacent and below the first region.

18. The display system of claim 16 further comprising:

a second region disposed between the first and second sidewalls and positioned adjacent and above the first region; and a second pair of slide members disposed on the first and second sidewalls and adapted to carry items for display within the second region, the second pair of slide members movable for transporting items carried on the second support toward a position outside the second region.

19. A frame structure for displaying a plurality of items, comprising:

a first end wall having first and second ends and a top edge;

a second end wall spaced apart from the first end wall in generally parallel orientation relative to the first end wall, the second end wall having first and second ends and a top edge;

a pair of spaced apart sidewalls extending between the first and second end walls, the end walls and sidewalls defining a base cavity, the pair of sidewalls having upper portions that extend a selected distance beyond at least one of the top edges of the first and second end walls;

a first pair of slide mechanisms mounted on the upper portions of the pair of sidewalls, a first slide mechanism of the first pair of slide mechanisms mounted on the first sidewall and a second corresponding slide mechanism of the first pair of slide mechanisms mounted on the second sidewall; and a collapsible display case formed integrally with said first pair of slide mechanisms, said display case having a front wall removeably supported by said first pair of slide mechanisms, a rear wall removeably supported by said first pair of slide mechanisms and removeably connected to the front wall, a base wall removeably supported by said first pair of slide mechanisms and sidewalls formed integrally with said first pair of slide mechanisms, said display case slidably moveable by said first pair of slide mechanisms between a first position wherein the display case is positioned over the base cavity and a second position wherein the display case passes over one of the top edges of the first and second end walls.

20. The frame structure of claim 5 wherein said display case includes:

a rear wall removeable from said first support;

sidewalls formed integrally with said first support; and a removeable viewing assembly including a base wall, a front wall foldably connected to the base wall and a transparent viewing wall foldably connected to said front wall.

21. The frame structure of claim 6 wherein each removeable connection between said sidewalls and said end walls includes a first fastener slidably engaged with a second fastener.

22. The display system of claim 16 wherein the first support carries a collapsible display tray including a front wall removable from said first support, a rear wall removeable from said first support, sides formed integrally with the first support and a base wall removeable from said first support.

23. The display system of claim 16 wherein the first support carries a box-shaped display case having an openable and transparent viewing wall on a top side thereof.

24. The display system of claim 23 wherein the display case is collapsible and integrally formed with the first support.

25. The display system of claim 16 wherein the anti-tipping device is a pair of support walls extending from one of the first and second sidewalls along a supporting surface.

* * * * *